US011644271B1

(12) United States Patent
Huang

(10) Patent No.: US 11,644,271 B1
(45) Date of Patent: May 9, 2023

(54) TOY GUN

(71) Applicant: DAWEI TECHNOLOGY CO., LTD, Grand Junction, CO (US)

(72) Inventor: Yubai Huang, Grand Junction, CO (US)

(73) Assignee: DAWEI TECHNOLOGY CO., LTD, Grand Junction, CO (US)

( * ) Notice: Subject to any disclaimer, the term of this patent is extended or adjusted under 35 U.S.C. 154(b) by 25 days.

(21) Appl. No.: 17/555,529

(22) Filed: Dec. 20, 2021

(51) Int. Cl.
*F41B 11/00* (2013.01)
*F41B 11/681* (2013.01)
*F41B 11/89* (2013.01)
*F41B 11/642* (2013.01)

(52) U.S. Cl.
CPC ..... *F41B 11/681* (2013.01); *F41B 11/642* (2013.01); *F41B 11/89* (2013.01)

(58) Field of Classification Search
CPC ..... F41B 11/723; F41B 11/64; F41B 11/89; F41B 11/54; F41B 11/681; F41B 11/642
USPC ..... 124/66, 73, 78, 56
See application file for complete search history.

(56) References Cited

U.S. PATENT DOCUMENTS 2,708,430 A * 5/1955 Smith ..... F41B 11/647 124/66
5,645,038 A * 7/1997 Luk ..... F41B 11/642 124/67
5,701,878 A * 12/1997 Moore ..... F41B 11/00 124/66
8,302,588 B2 * 11/2012 Chen ..... F41B 7/08 124/66
2007/0006862 A1 * 1/2007 Zimmerman ..... F41B 11/648 124/66
2008/0155875 A1 * 7/2008 Iwasawa ..... F41B 11/644 42/54
2010/0180878 A1 * 7/2010 Funaki ..... F41B 11/646 124/66
2010/0307472 A1 * 12/2010 Witzigreuter ..... F41B 11/681 473/569
2011/0041824 A1 * 2/2011 Jablonski ..... F41B 11/89 124/65
2011/0186595 A1 * 8/2011 Garces ..... F41B 9/0037 222/79
2012/0304975 A1 * 12/2012 Ma ..... F41B 11/681 124/73
2013/0192576 A1 * 8/2013 Ma ..... F41B 9/0071 124/73
2015/0065005 A1 * 3/2015 Zimmerman ..... F41B 11/684 446/24
2019/0346231 A1 * 11/2019 Ma ..... F41A 11/04
2022/0381533 A1 * 12/2022 Xia ..... F41B 11/55

* cited by examiner

*Primary Examiner* — Michael D David

(57) ABSTRACT

The present invention discloses a toy gun, and relates to the technical field of toys. In the present invention, a driving mechanism drives a gear set to rotate, and the gear set drives a piston to move reciprocally in a cylinder body, so that the piston compresses air in the cylinder body, and high-pressure air is ejected from an air nozzle. After a gel ball is loaded into a gun barrel, since the air nozzle is inserted at one end of the gun barrel, the compressed air ejected from the air nozzle pushes the gel ball out of the gun barrel, thereby realizing the firing of the gel ball. Compared with the toy gun that cannot fire bullets in the traditional art, the present invention improves the playability.

8 Claims, 6 Drawing Sheets

TOY GUN

TECHNICAL FIELD

The present invention relates to the technical field of toys, in particular to a toy gun.

BACKGROUND

With the development of society, people's living standards continue to improve, and toy guns for children are becoming more and more scientific and technological. In order to prevent solid plastic bullets from hurting people, there is a bullet made of water-absorbing resin on the market, referred to as a gel ball, which will gradually absorb water after being put into the water and become spherical, bringing strong elasticity and safety. However, the firing of such gel ball requires a corresponding toy gun. The existing toy guns are more photoelectric, pursuing sound diversity and loveliness, and difficultly fire the gel balls mentioned above, so that the playability is reduced.

SUMMARY

The objective of the present invention is to provide a toy gun, so as to realize the firing of much safer gel balls and improve the playability.

To achieve the above objective, the technical solution adopted by the present invention is as follows:

a toy gun includes a gun shell, a driving mechanism, a gear set, an inflatable set and a gun barrel, wherein the inflatable set is arranged in the gun shell in a sliding manner, and the driving mechanism drives the gear set to rotate;

the inflatable set includes a cylinder body and a piston, the piston is arranged in the cylinder body in a sliding manner, one end of the cylinder body is fixedly provided with an air nozzle which is inserted at one end of the gun barrel, and the gear set drives the piston to move reciprocally in the cylinder body, and at the same time drives the cylinder body to move reciprocally in the gun shell.

Further, an upper side of the gun barrel is provided with a loading hole, and the air nozzle and the loading hole are matched with each other.

Further, the driving mechanism includes a power supply, a touch switch and a motor, and the power supply, the touch switch and the motor are electrically connected in series and in sequence.

Further, the gear set includes a cylindrical gear, a first transmission gear, a second transmission gear, a third transmission gear and a fourth transmission gear; the motor drives the cylindrical gear to rotate; and the cylindrical gear, the first transmission gear, the second transmission gear, the third transmission gear and the fourth transmission gear are in an engaged transmission in turn.

Further, the fourth gear is fixedly provided with a first half gear and a second half gear, a tip diameter of the first half gear is less than that of the second half gear, the cylinder body is fixedly provided with a first rack, the first half gear and the first rack cooperate with each other, the piston is fixedly provided with a second rack, and the second half gear and the second rack cooperate with each other.

Further, the gear set further includes a check member and a torsion spring, the check member abuts against a side surface of the first transmission gear by means of the torsion spring, one end of the check member is provided with check teeth, the side surface of the first transmission gear is provided with check grooves, and the check teeth and the check grooves cooperate with each other.

Further, the gun shell is internally provided with a smooth bore, the cylinder body is arranged in the smooth bore in a sliding manner, a side wall of the smooth bore is provided with a chute, an outer side of the cylinder body is fixedly provided with a first slider, an outer side of the piston is fixedly provided with a second slider, and the first slider and the second slider are both arranged in the chute in a sliding manner.

Further, the inflatable set further includes a push spring, a guide rod and a tension spring; one end of the piston away from the cylinder body is provided with a guide groove, the guide rod and the guide groove cooperate with each other, one end of the guide rod away from the guide groove is fixedly provided with a stopper, one end of the push spring abuts into the guide groove, the other end of the push spring is arranged on the guide rod in a sleeving manner and abuts against the stopper, and the cylinder body abuts against the gun barrel by means of the tension spring.

The present invention has the beneficial effect as follows: in the present invention, the driving mechanism drives the gear set to rotate, and the gear set drives the piston to move reciprocally in the cylinder body, so that the piston compresses air in the cylinder body, and high-pressure air is ejected from the air nozzle. After a gel ball is loaded into the gun barrel, since the air nozzle is inserted at one end of the gun barrel, the compressed air ejected from the air nozzle pushes the gel ball out of the gun barrel, thereby realizing the firing of the gel ball. Compared with the toy gun that cannot fire bullets in the traditional art, the present invention improves the playability.

Figure 1:
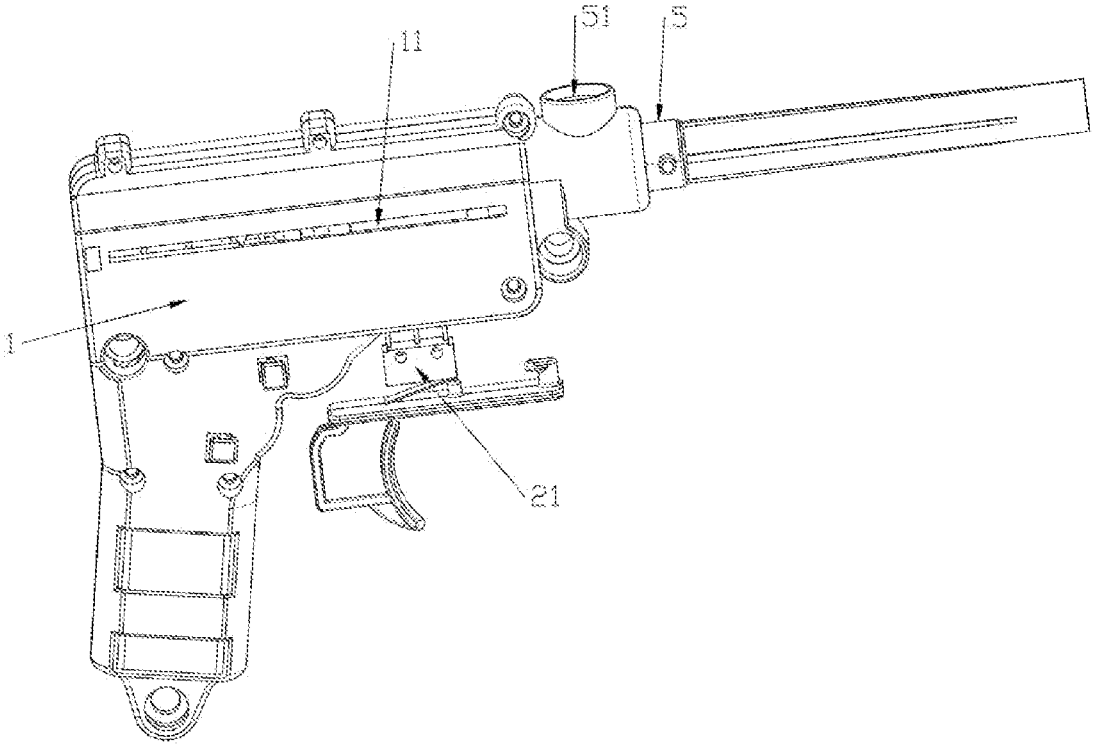
FIG. 1 is a schematic diagram of an overall structure of the present invention.

Reference number listing is as follows:

gun shell 1, chute 11, touch switch 21, motor 22 gear set 3, cylindrical gear 31, first transmission gear 32, check groove 321, second transmission gear 33, third transmission gear 34, fourth transmission gear 35, first half gear 351, second half gear 352, check member 36, check teeth 361, torsion spring 37, inflatable set 4, cylinder body 41, air nozzle 411, air inlet 410, first slider 412, first rack 414, piston 42, second slider 421, second rack 422, guide groove 423, push spring 43, guide rod 44, stopper 441, tension spring 45, gun barrel 5, and loading hole 51.

DETAILED DESCRIPTION

The present invention is further described with reference to the drawings.

Figure 2:
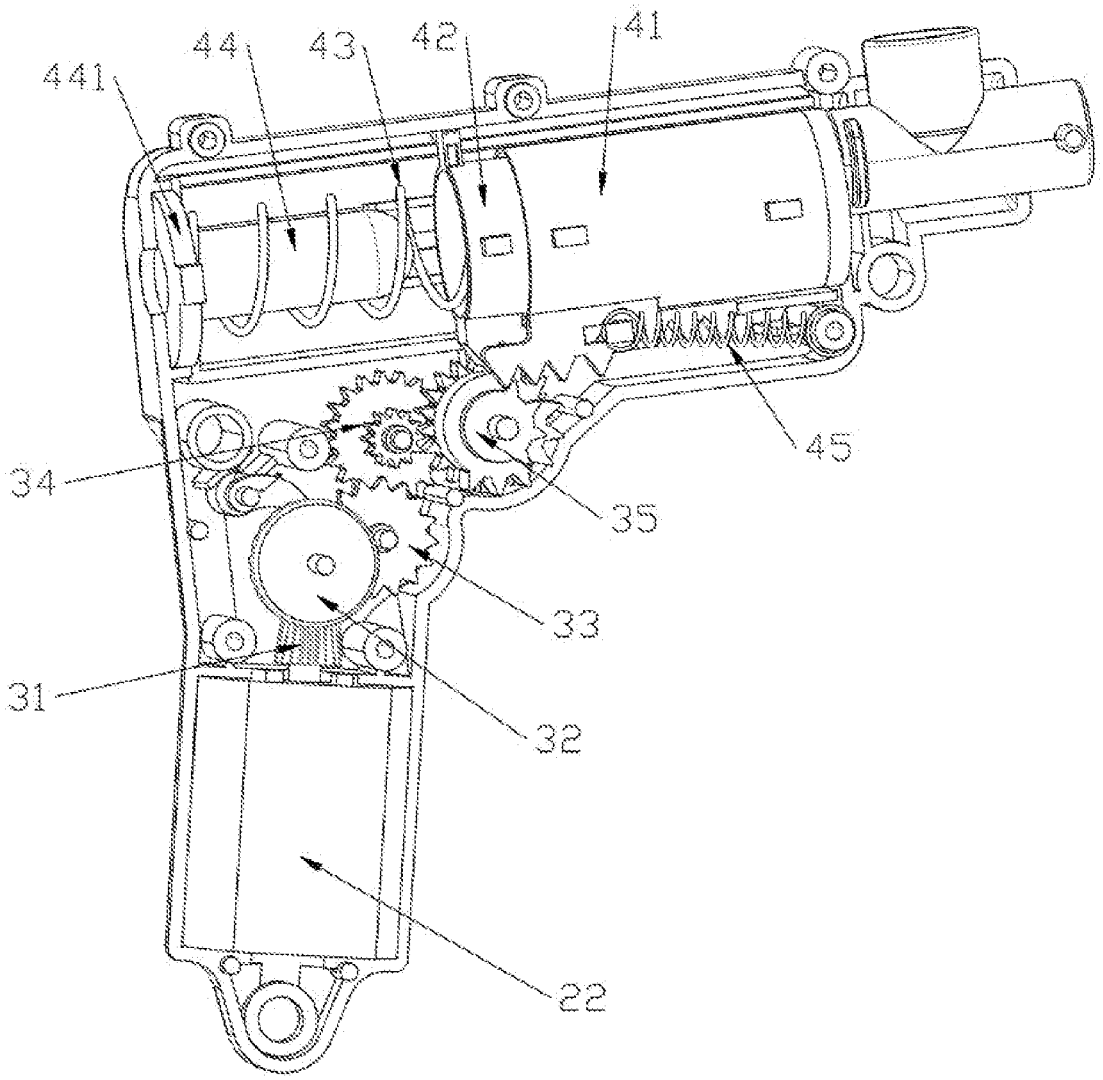
FIG. 2 is a schematic diagram of an internal structure of the present invention.
Figure 3:
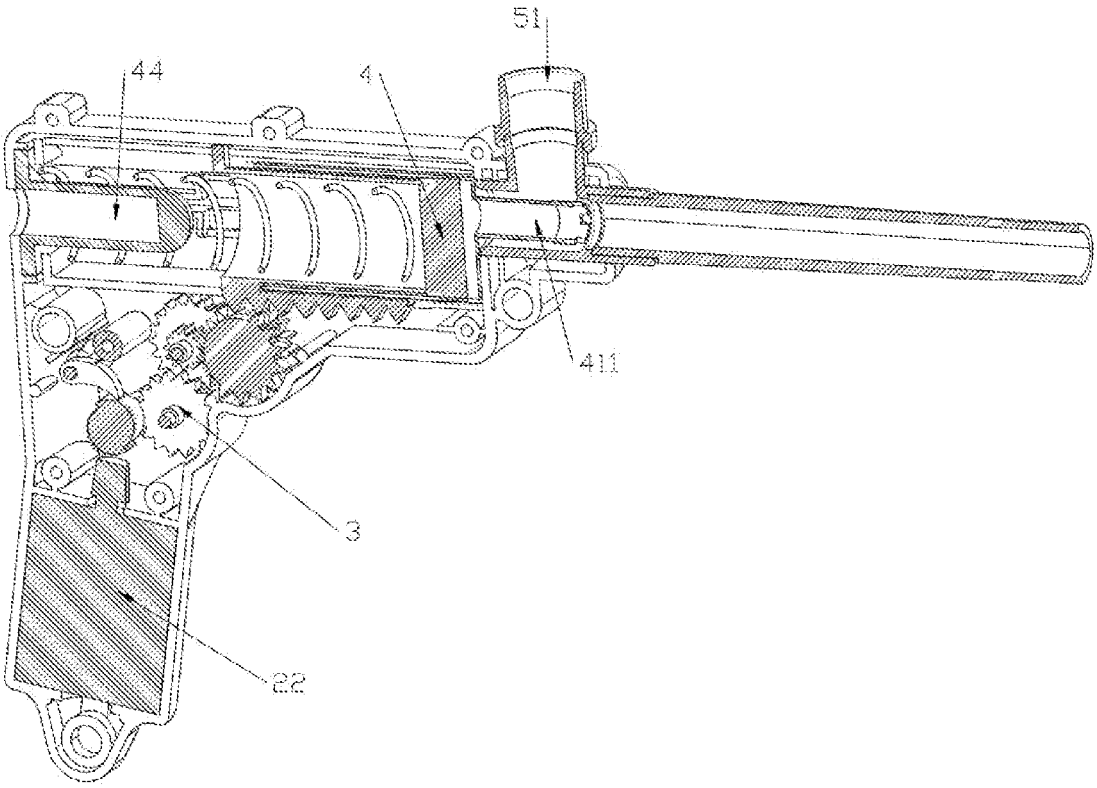
FIG. 3 is a cross-sectional view of an internal structure of a gun shell in the present invention.
Figure 4:
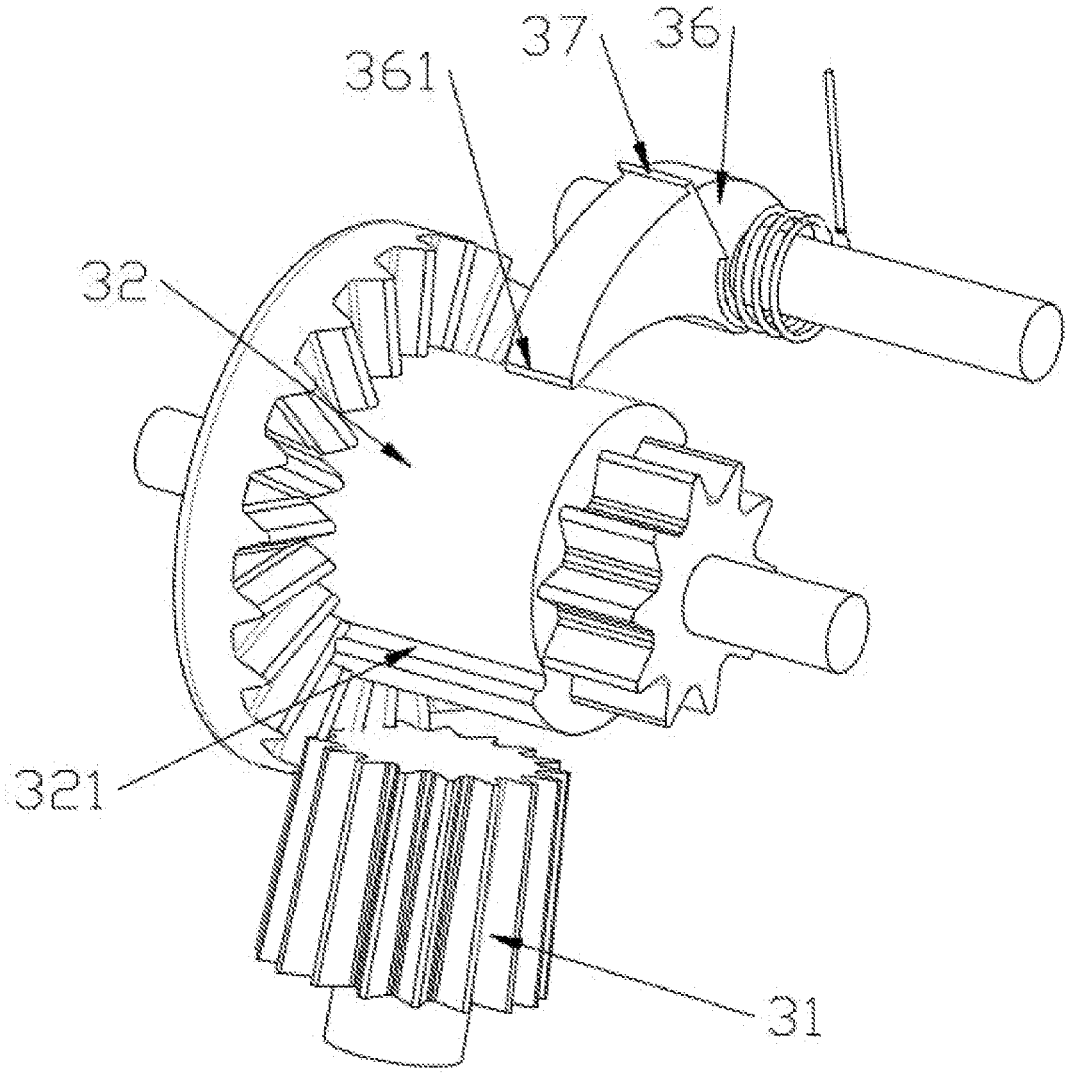
FIG. 4 is a schematic structural diagram of a cylindrical gear, a first transmission gear, a check member and a torsion spring in the present invention.
Figure 5:
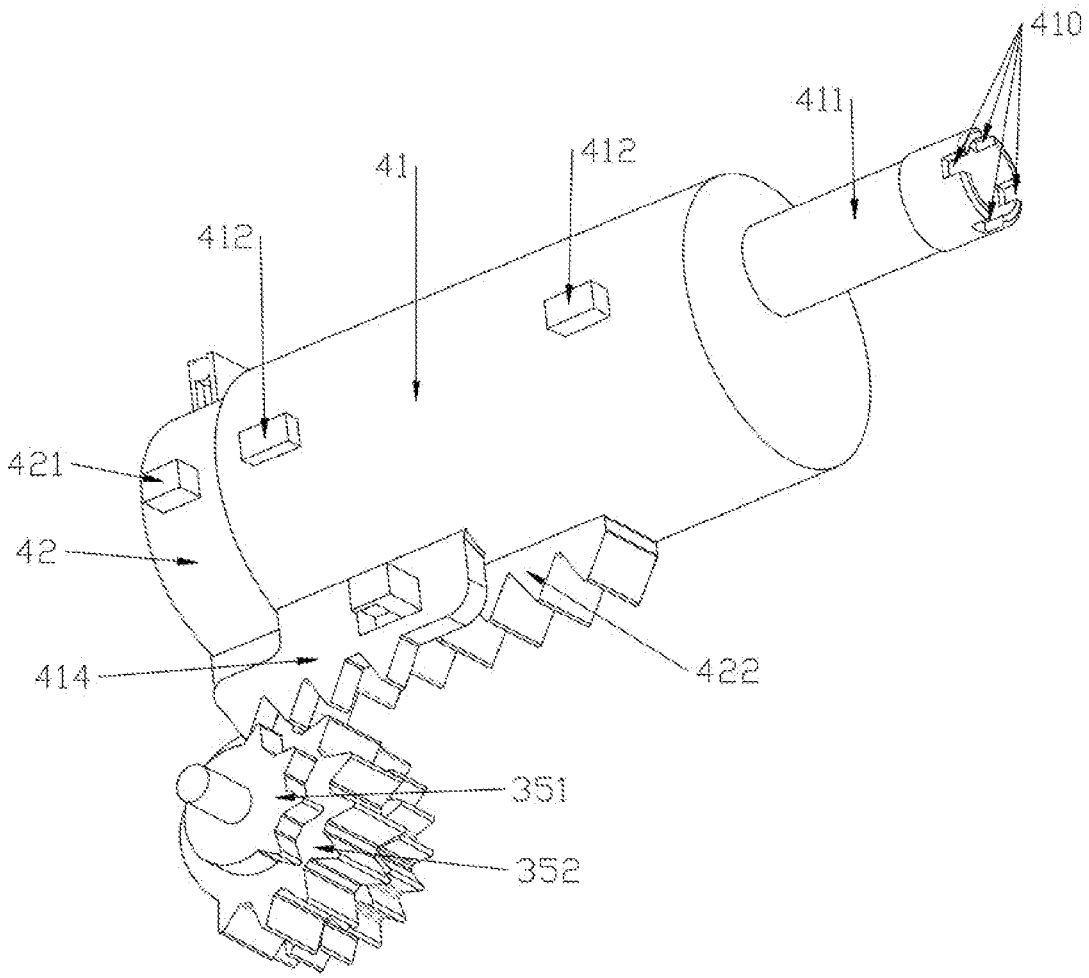
FIG. 5 is a schematic structural diagram of a fourth transmission gear, a cylinder body and a piston in the present invention.
Figure 6:
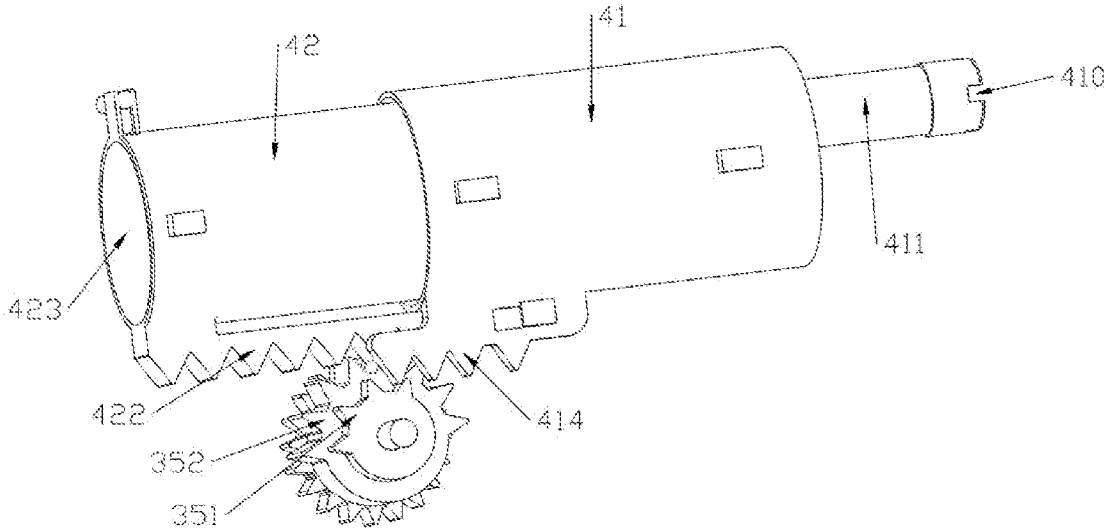
FIG. 6 is a schematic structural diagram of a fourth transmission gear driving a piston to extend out of a cylinder body in the present invention.

A toy gun as shown in FIGS. 1 to 6 includes a gun shell 1, a driving mechanism, a gear set 3, an inflatable set 4 and a gun barrel 5, wherein the inflatable set 4 is arranged in the gun shell 1 in a sliding manner, and the driving mechanism drives the gear set 3 to rotate.

The driving mechanism includes a power supply, a touch switch 21 and a motor 22, wherein the power supply, the touch switch 21 and the motor 22 are electrically connected in series and in sequence by means of wires, the power supply is used to supply power to the motor 22, and the touch switch 21 is used to control the start and stop of the power supply.

The gear set 3 includes a cylindrical gear 31, a first transmission gear 32, a second transmission gear 33, a third transmission gear 34, a fourth transmission gear 35, a check member 36 and a torsion spring 37, wherein the motor 22 drives the cylindrical gear 31 to rotate, and the cylindrical gear 31, the first transmission gear 32, the second transmission gear 33, the third transmission gear 34 and the fourth transmission gear 35 are in an engaged transmission in turn.

The motor 22 drives the cylindrical gear 31 to rotate at a high speed, the cylindrical gear 31 drives the first transmission gear 32 to rotate to form a first-stage deceleration effect; the first transmission gear 32 drives the second transmission gear 33 to rotate to form a second-stage deceleration effect; the second transmission gear 33 drives the third transmission gear 34 to rotate to form a third-stage deceleration effect; the third transmission gear 34 drives the fourth transmission gear 35 to rotate to form a fourth-stage deceleration effect; and the power from the motor 22 forms a larger torque by means of multi-stage deceleration of the gear set 3, which is more conducive to driving the operation of the inflatable set 4.

The inflatable set 4 includes a cylinder body 41, a piston 42, a push spring 43, a guide rod 44 and a tension spring 45, wherein the piston 42 is arranged in the cylinder body 41 in a sliding manner, one end of the cylinder body 41 is fixedly provided with an air nozzle 411 which is inserted at one end of the gun barrel 5, and the gear set 3 drives the piston 42 to move reciprocally in the cylinder body 41, and at the same time drives the cylinder body 41 to move reciprocally in the gun shell 1.

The gun shell 1 is internally provided with a smooth bore, the cylinder body 41 is arranged in the smooth bore in a sliding manner, a side wall of the smooth bore is provided with a chute 11, an outer side of the cylinder body 41 is fixedly provided with a first slider 412, an outer side of the piston 42 is fixedly provided with a second slider 421, and the first slider 412 and the second slider 421 are both arranged in the chute 11 in a sliding manner; the cylinder body 41 can slide back and forth in the smoothbore, the first slider 412 is arranged in the chute 11 in a sliding manner, so as to ensure that the sliding of the cylinder body 41 is more stable; at the same time, the piston 42 is arranged in the cylinder body 41 in a sliding manner, and the second slider 421 is arranged in the chute 11 in a sliding manner, so as to ensure that the sliding of the piston 42 is more stable.

One end of the piston 42 away from the cylinder body 41 is provided with a guide groove 423, the guide rod 44 and the guide groove 423 cooperate with each other, one end of the guide rod 44 away from the guide groove 423 is fixedly provided with a stopper 441, one end of the push spring 43 abuts into the guide groove 423, the other end of the push spring 43 is arranged on the guide rod 44 in a sleeving manner and abuts against the stopper 441, and the push spring 43 is compressed between the stopper 441 and the piston 42, so that the piston 42 is pushed back into the cylinder body 41; the cylinder body 41 abuts against the gun barrel 5 by means of the tension spring 45, one end of the tension spring 45 is fixed inside the gun shell 1, and the other end of the tension spring 45 is fixed on the cylinder body 41; under the action of the tension spring 45, the cylinder body 41 is pulled toward the gun barrel 5, so that the air nozzle 411 is completely inserted into the gun barrel 5.

An upper side of the gun barrel 5 is provided with a loading hole 51, a gel ball is loaded into the gun barrel 5 from the loading hole 51, the diameter of the gel ball is slightly greater than the inner diameter of the gun barrel 5, and the air nozzle 411 and the loading hole 51 cooperate with each other; when the air nozzle 411 is completely inserted into the gun barrel 5, the lower end of the loading hole 51 is completely blocked by the air nozzle 411.

The fourth gear is fixedly provided with a first half gear 351 and a second half gear 352, a tip diameter of the first half gear 351 is less than that of the second half gear 352, the cylinder body 41 is fixedly provided with a first rack 414, the first half gear 351 and the first rack 414 cooperate with each other, the piston 42 is fixedly provided with a second rack 422, and the second half gear 352 and the second rack 422 cooperate with each other.

The first half gear 351 and the first rack 414 are engaged with each other, when the fourth transmission gear 35 rotates, the first half gear 351 and the second half gear 352 are driven at the same time to rotate, the first half gear 351 drives the first rack 414 to move, the first rack 414 drives the cylinder body 41 to move backward along the smoothbore, the cylinder body 41 drives the air nozzle 411 to extend out from the gun barrel 5 until the air nozzle 411 leaves the loading hole 51, and at this time, the gel ball in the loading hole 51 falls into the gun barrel 5 by means of gravity; when the first half gear 351 rotates half a turn and is disengaged from the first rack 414, under the action of the tension spring 45, the cylinder body 41 is pulled toward the gun barrel 5, and at the same time, the air nozzle 411 is inserted into the gun barrel 5 again and pushes the gel ball falling into the gun barrel 5 forward, so that the gel ball leaves the loading hole 51 and is stuck in the gun barrel 5.

The second gear and the second rack 422 are engaged with each other, when the fourth transmission gear 35 rotates, the first half gear 351 and the second half gear 352 are driven at the same time to rotate, the second half gear 352 drives the second rack 422 to move, the second rack 422 drives the piston 42 to move backward along the cylinder body 41, air enters the cylinder body 41 from the air nozzle 411, and a front end of the air nozzle 411 away from the cylinder body 41 is provided with an air inlet 410, so as to ensure that when the air nozzle 411 abuts against the gel ball, the air can still enter the interior of the cylinder body 41 through the air inlet 410; when the second half gear 352 rotates half a turn and is disengaged from the second rack 422, under the push of the push spring 43, the piston 42 is pushed toward the cylinder body 41, so that the air in the cylinder body 41 is compressed, and the compressed air is ejected from the air nozzle 411, thereby pushing the gel ball forward to achieve the firing of the gel ball.

When the fourth transmission gear 35 rotates, the first half gear 351 and the second half gear 352 are driven at the same time to rotate, so that the piston 42 and the cylinder body 41 move backward at the same time; the cylinder body 41 moves backward a shorter distance, which only needs to ensure that the air nozzle 411 pushes the bullet at the loading hole 51 into the gun barrel 5, while the piston 42 needs to move backward a longer distance, which needs to ensure that sufficient air pressure is generated in the cylinder body 41; since the tip diameter of the first half gear 351 is less than that of the second half gear 352, the distance of the piston 42 moving backward is ensured to be greater than the distance of the cylinder body 41 moving backward according to actual needs.

The check member 36 abuts against aside surface of the first transmission gear 32 by means of the torsion spring 37, one end of the check member 36 is provided with check teeth 361, the side surface of the first transmission gear 32 is provided with check grooves 321, and the check teeth 361 and the check grooves 321 are matched with each other; the gear set 3 is used to prevent the first transmission gear 32 from reversing and causing damage to other components; the check member 36 abuts against the side surface of the first transmission gear 32 under the action of the torsion spring 37, when the first transmission gear 32 rotates forward, the check teeth 361 scrape on the side surface of the first transmission gear 32, and at the same time scrape on the check grooves 321; and when the first transmission gear 32 rotates in reverse, the check teeth 361 are stuck in the check grooves 321, so as to prevent the first transmission gear 32 from reversing.

The working principle of the present invention is as follows:

1. the gel ball is loaded into the gun barrel 5 from the loading hole 51, and the driving mechanism drives the gear set 3 to rotate;

2. when the fourth transmission gear 35 rotates, the first half gear 351 and the second half gear 352 are driven at the same time to rotate, the first half gear 351 drives the first rack 414 to move, the first rack 414 drives the cylinder body 41 to move backward along the smoothbore, the cylinder body 41 drives the air nozzle 411 to extend out from the gun barrel 5 until the air nozzle 411 leaves the loading hole 51, and at this time, the gel ball in the loading hole 51 falls into the gun barrel 5 by means of gravity; when the first half gear 351 rotates half a turn and is disengaged from the first rack 414, under the action of the tension spring 45, the cylinder body 41 is pulled toward the gun barrel 5, and at the same time, the air nozzle 411 is inserted into the gun barrel 5 again and pushes the gel ball falling into the gun barrel 5 forward, so that the gel ball leaves the loading hole 51 and is stuck in the gun barrel 5; and 3. the second half gear 352 drives the second rack 422 to move, the second rack 422 drives the piston 42 to move backward along the cylinder body 41, air enters the cylinder body 41 from the air nozzle 411, and the front end of the air nozzle 411 away from the cylinder body 41 is provided with an air inlet 410, so as to ensure that when the air nozzle 411 abuts against the gel ball, the air can still enter the interior of the cylinder body 41 through the air inlet 410; when the second half gear 352 rotates half a turn and is disengaged from the second rack 422, under the push of the push spring 43, the piston 42 is pushed toward the cylinder body 41, so that the air in the cylinder body 41 is compressed, and the compressed air is ejected from the air nozzle 411, thereby pushing the gel ball forward to achieve the firing of the gel ball.

The present invention can be implemented in many other ways different from those described herein, and a person skilled in the art can make similar modifications without departing from the connotation of the present invention. Therefore, the present invention is not limited to the specific embodiments disclosed below.

The invention claimed is:

1. A toy gun, comprising a gun shell, and further comprising a driving mechanism, a gear set, an inflatable set and a gun barrel, wherein the inflatable set is arranged in the gun shell in a sliding manner, and the driving mechanism drives the gear set to rotate;

the inflatable set comprises a cylinder body and a piston, the piston is arranged in the cylinder body in a sliding manner, one end of the cylinder body is fixedly provided with an air nozzle which is inserted at one end of the gun barrel, and the gear set drives the piston to move reciprocally in the cylinder body, and at the same time drives the cylinder body to move reciprocally in the gun shell.

2. The toy gun according to claim 1, wherein an upper side of the gun barrel is provided with a loading hole, and the air nozzle and the loading hole are matched with each other.

3. The toy gun according to claim 1, wherein the driving mechanism comprises a power supply, a touch switch and a motor, and the power supply, the touch switch and the motor are electrically connected in series and in sequence.

4. The toy gun according to claim 3, wherein the gear set comprises a cylindrical gear, a first transmission gear, a second transmission gear, a third transmission gear and a fourth transmission gear; the motor drives the cylindrical gear to rotate; and the cylindrical gear, the first transmission gear, the second transmission gear, the third transmission gear and the fourth transmission gear are in an engaged transmission in turn.

5. The toy gun according to claim 4, wherein the fourth gear is fixedly provided with a first half gear and a second half gear, a tip diameter of the first half gear is less than that of the second half gear, the cylinder body is fixedly provided with a first rack, the first half gear and the first rack cooperate with each other, the piston is fixedly provided with a second rack, and the second half gear and the second rack cooperate with each other.

6. The toy gun according to claim 5, wherein the gear set further comprises a check member and a torsion spring, the check member abuts against the side surface of the first transmission gear by means of the torsion spring, one end of the check member is provided with check teeth, the side surface of the first transmission gear is provided with check grooves, and the check teeth and the check grooves cooperate with each other.

7. The toy gun according to claim 1, wherein the gun shell is internally provided with a smooth bore, the cylinder body is arranged in the smoothbore in a sliding manner, a side wall of the smoothbore is provided with a chute, an outer side of the cylinder body is fixedly provided with a first slider, an outer side of the piston is fixedly provided with a second slider, and the first slider and the second slider are both arranged in the chute in a sliding manner.

8. The toy gun according to claim 1, wherein the inflatable set further comprises a push spring, a guide rod and a tension spring; one end of the piston away from the cylinder body is provided with a guide groove, the guide rod and the guide groove cooperate with each other, one end of the guide rod away from the guide groove is fixedly provided with a stopper, one end of the push spring abuts into the guide groove, the other end of the push spring is arranged on the guide rod in a sleeving manner and abuts against the stopper, and the cylinder body abuts against the gun barrel by means of the tension spring.

* * * * *